United States Patent [19]

Marrotte et al.

[11] 4,036,102

[45] July 19, 1977

[54] CARTRIDGE BELT GUIDE FOR AMMUNITION BOX

[76] Inventors: Gary J. Marrotte, 18 Red Pine Road, Medford, N.Y. 11763; H. Christopher Mulder, 142 Wilson Ave., Long Beach, N.Y. 11561

[21] Appl. No.: 651,126

[22] Filed: Jan. 21, 1976

[51] Int. Cl.[2] ..... F41D 9/02

[52] U.S. Cl. ..... 89/33 BB; 193/2 R; 193/25 AC

[58] Field of Search ..... 89/33 BB, 33 BC, 34; 193/2 R, 4, 25 R, 25 A, 25 C, 25 AC

[56] References Cited

U.S. PATENT DOCUMENTS

| | | | |
|---|---|---|---|
| 1,483,987 | 2/1924 | Rockwell | 89/34 |
| 2,363,219 | 11/1944 | Adamson | 193/2 R |

*Primary Examiner*—Stephen C. Bentley

*Attorney, Agent, or Firm*—Bucknam and Archer

[57] ABSTRACT

A cartridge belt guide for an ammunition box that clamps to an edge portion of the box and has a curved guide surface held in overextending relation to such edge. The guide surface is positioned for sliding contact with the cartridge belt to facilitate withdrawal thereof from the ammunition box without snagging on the edge of the box.

6 Claims, 3 Drawing Figures

CARTRIDGE BELT GUIDE FOR AMMUNITION BOX

BACKGROUND AND SUMMARY OF THE INVENTION

This invention relates in general to light ordnance, and more particularly to a cartridge belt guide for ammunition box.

In the typical operation of light machine guns, the ammunition is stored belted together in boxes, and the belt is fed directly to the gun from the box.

Generally, a cartridge belt is laid into an ammunition box serpentine fashion, with one belt section on top of the other, and all of the cartridges aligned with their length axes parallel to the smaller width, or end wall of the box. The width of the end wall corresponds approximately to the length of the cartridge belted. As the ammunition is used by a machine gun, the belt is drawn out of the box over the end wall, and advanced to the gun by the action thereof.

When the box is directly under or in line with the gun infeed port, the belt can usually be withdrawn from the box as the gun is fired, without restriction by any wall or edge of the box. However, where the box is located in an offset relation to the gun port, or in any positin where the belt can hang down below the top of the box, there is the possibility of the belt becoming snagged on an edge of the box.

The invention solves this snagging problem by providing a cartridge belt guide having clamp means disposed to engage a wall of the ammunition box for support thereby. A guide member is connected to such clamp means for support thereby in overextending relation to the upper edge of the wall. This guide member has a preferably curved surface positioned for sliding contact engagement with the cartridge belt to facilitate the withdrawal thereof from the ammunition box.

Consequently, the cartridge belt never rides over, in contact, with the box edge, and therefore does not snag on the edge, or on any other part of the box.

For a better understanding of the invention and its several advantages, reference should be had to the following detailed description and accompanying drawings, which together exemplify a certain preferred embodiment of the invention.

DESCRIPTION OF A PREFERRED EMBODIMENT OF THE INVENTION

Figure 1:
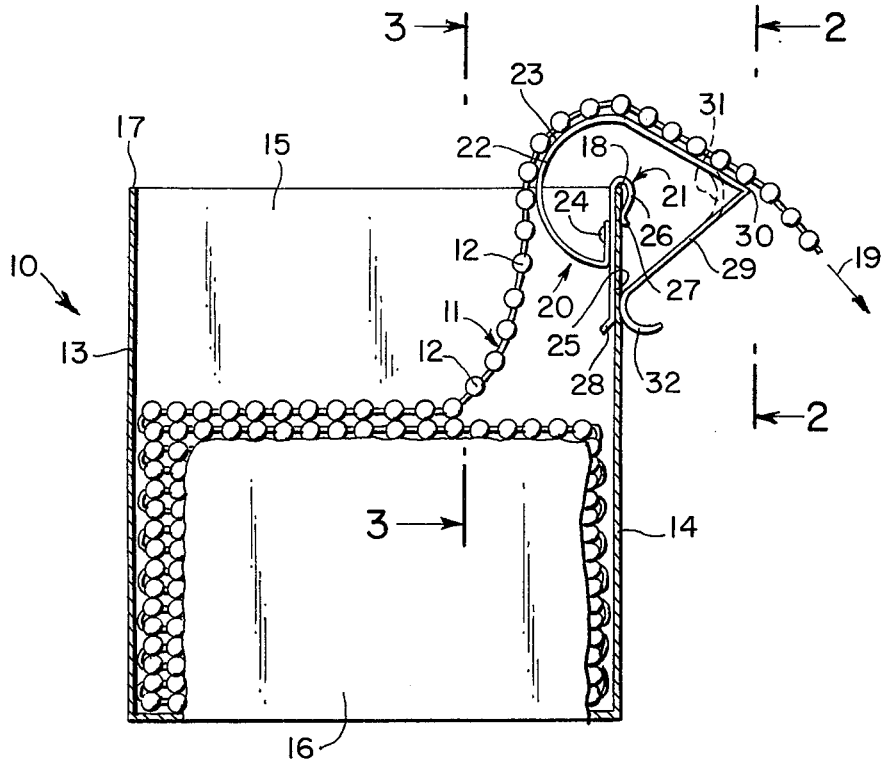
FIG. 1 is a side elevation view, partly in section, showing a cartridge belt guide according to a preferred embodiment of the invention, as seen installed upon a typical ammunitin box for use in facilitating the withdrawal of a cartridge belt contained in such box.

In FIG. 1 there is illustrated a typical ammunition box 10 commonly used to contain ammunition belted together for use by a light machine gun (not shown). Inside box 10 is a continuous length cartridge belt 11 commonly made up of about 250 rounds of individual cartridges 12. Belt 11 is laid into box 10 in serpentine fashion between left end wall 13 and right end wall 14, and between back wall 15 and a front wall 16 parallel thereto which is partially removed to show the contents of box 10. The widths of the end walls 13, 14 are typically equal to the length of cartridge 12 belted, and the cartridges 12 are aligned in box 10 with their length axes generally parallel to walls 13, 14 and their upper edges 17, 18 respectively.

In typical firing of the gun, the belt 11 is advanced in the direction of the arrow 19 by the action of the gun feed mechanism. For the example shown by FIG. 1 it should be noted that the belt 11 must rise upward out of box 10 and then descend below the upper edge 18 of the end wall 14. If the belt 11 were not in some way assisted in passing over the edge 18, it could become easily snagged thereon, resulting in possible jamming of the gun.

To avoid such problems, the invention provides a cartridge belt guide 20 having clamp means 21 disposed to engage the wall 14 of box 10 for support thereby; and a guide member 22 connected to said clamp means 21 for support thereby in overextending relation to the edge 18 of wall 14, the guide member 22 having a curved guide surface 23 positioned for sliding contact engagement with cartridge belt 11, or more precisely with the cartridge 12 of belt 11, to facilitate the withdrawal of belt 11 from the box 10.

Figure 2:
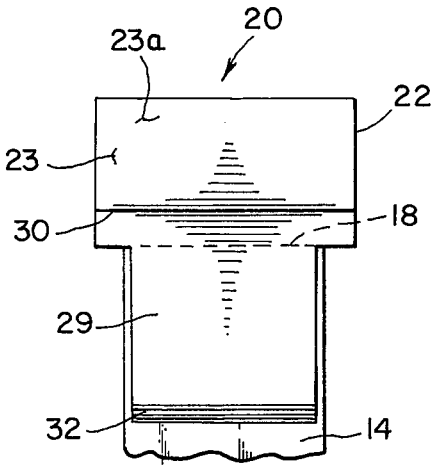
FIG. 2 is a front elevation view of the cartridge belt guide itself, as taken along line 2—2 in FIG. 1.
Figure 3:
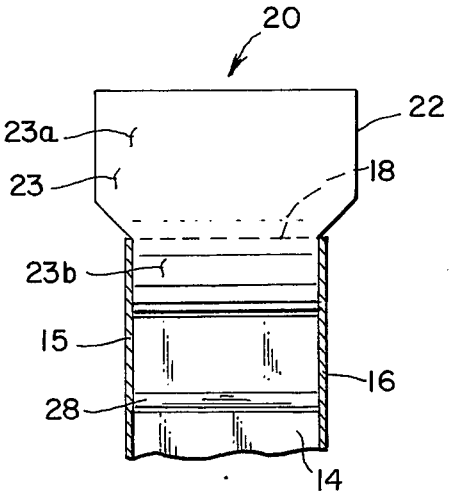
FIG. 3 is a rear elevation view of the cartridge belt guide itself, as taken along line 3—3 in FIG. 1.

As can be seen from the profile of guide 20 shown in FIG. 1, and from the transverse opposing views of FIGS. 2 and 3, the guide 20 is expendiently made of sheet metal in which case the clamp means 21 and guide member 22 can be either made of a single piece of sheet metal, or can be made of two separate pieces of sheet metal connected as by spot welds at 24. In either case the surfaces of the clamp means 21 and guide member extend generally parallel to edge 18.

Clamp means 21 has a generally flat surface 25 disposed to lie against wall 14 on the inside of box 10, and a hook portion 26 disposed to extend around edge 18 from inside box 10 and overlie wall 14 on the outside of box 10. The free end 27 of hook 26 can be bent to a position at which it resiliently engages wall 14, or it can be set a position providing a certain degree of clearance with wall 14, as desired. Expediently clamp means 21 has a lip 28 bent away from wall 14 to allow easy installation of the clamp means 21 on wall 14 simply by pushing downwardly to slide surface 25 along wall 14 unit1 edge 18 is within hook portion 26.

Guide 20 preferably has a bracing member 29 connected to guide member 22 and disposed to resiliently engage wall 14 outside box 10 to stabilize the placement of the guide member 22. Bracing member 29 and guide member 22 are expediently integrally connected as portions of a common metal sheet. This connection can be as at a sharp bend 30, or by a smoother, larger radius bend as indicated at 31 in phantom outline. Bracing member 29 expediently has a recurved portion 32 at its free end, and this portion 32 is arranged to press against wall 14 at a location somewhere behind the flat surface 25.

As seen better from FIGS. 2 and 3, the guide member 22 has a greater width for the portion **23*a* of guide surface 23 that extends above box 10 than for the portion 23*b* that extends into box 10. The clamp means 21, bracing member 29 and the guide surface portion 23*b* have widths approximately the same as the width of wall 14 as measured along edge 18, the clamp means 21 and surface portion 23b being somewhat less so as to fit inside box 10 along wall 14**. However, the guide surface 23 has a maximum width over the portion 23*a* so as to give the belt 11 a wider support to allow for belt 11 shifting as the gun is pivoted, this width of portion 23*a* being greater than the width of wall 14 as measured along edge 18.

The artisan will realize from the drawing and description herein, that the cartridge belt guide 20 could just s well be emplaced upon the left wall 13 of box 10, in the same manner as shown on wall 14, but with the guide 20 turned toward the left, should it be desired to feed the belt 11 leftwards.

One of the advantages of the invention is that the cartridge belt guide 20 is relatively light can be carried into the field to follow placement of the gun. When a box of belted ammunition is opened, guide 20 can be easily slipped into the operational position shown by FIG. 1, and when the box is emptied, guide 20 can easily be removed and placed upon the next box to be used.

The invention is adaptable to other variations and modifications, as will become apparent to those skilled in the art upon reading the disclosure herein.

What is claimed is:

1. A cartridge belt guide for an ammunition box, which comprises clamp means disposed to engage a wall of an ammunition box for support thereby; and a guide member connected to said clamp means for support thereby in overextending relation to an edge of said wall, said guide member having a guide surface positioned for sliding contact engagement with a cartridge belt to facilitate the withdrawal thereof from the ammunition box, said clamp means having a generally flat surface disposed to lie against said wall on the inside of the ammunition box and having a hook portion disposed to extend around said edge from inside the ammunition box and overlie said wall on the outside of the ammunition box.

2. A cartridge belt guide according to claim 1 wherein said guide surface has a maximum width greater than the width of said wall as measured along said edge.

3. A cartridge belt guide according to claim 1 wherein said clamp means and guide member are made of sheet metal and have respective surfaces extending generally parallel to said edge.

4. A cartridge belt guide according to claim 1 including a bracing member connected to said guide member and disposed fo engagement with said wall to stabilize the placement of said guide member.

5. A cartridge belt guide according to claim 1 including a bracing member connected to said guide member and disposed to resiliently engage said wall on the outside of the ammunition box to stabilize the placement of said guide member.

6. A cartridge belt guide according to claim 4 wherein said guide member and bracing member are integrally connected as portions of a common metal sheet.

* * * * *